US005397287A

United States Patent [19]

Lindfors

[11] Patent Number: 5,397,287

[45] Date of Patent: Mar. 14, 1995

[54] MUSCLE EXERCISING DEVICE

[76] Inventor: Kai Lindfors, Knut Stangenbergs Väg 2, S-131 47 Nacka, Sweden

[21] Appl. No.: 98,407

[22] PCT Filed: Feb. 6, 1991

[86] PCT No.: PCT/SE92/00068

§ 371 Date: Aug. 4, 1993

§ 102(e) Date: Aug. 4, 1993

[87] PCT Pub. No.: WO92/13603

PCT Pub. Date: Aug. 20, 1992

[30] Foreign Application Priority Data

Feb. 6, 1991 [SE] Sweden ..... 9100369
Apr. 22, 1991 [SE] Sweden ..... 9101207

[51] Int. Cl.[6] ..... A03B 21/008

[52] U.S. Cl. ..... 482/92; 482/112; 482/113

[58] Field of Search ..... 482/92, 101, 111–113, 482/120, 133–139

[56] References Cited

U.S. PATENT DOCUMENTS

| | | | |
|---|---|---|---|
| 3,369,403 | 2/1968 | Carlin et al. | 482/113 |
| 3,465,592 | 9/1969 | Perrine | 482/113 X |
| 3,495,824 | 2/1970 | Cuinier | 482/113 |
| 3,572,700 | 3/1971 | Mastropaolo | 482/112 X |
| 3,606,318 | 9/1971 | Gilstrap | 482/112 |
| 4,050,310 | 9/1977 | Keiser | 482/112 X |
| 4,290,599 | 9/1981 | Berger . | |
| 4,293,127 | 10/1981 | Dudley | 482/120 |
| 4,326,707 | 4/1982 | Strecker | 482/113 |
| 4,448,412 | 5/1984 | Brentham . | |
| 4,465,274 | 8/1984 | Davenport . | |
| 4,471,957 | 9/1984 | Engalitcheff, Jr. | 482/113 X |
| 4,576,377 | 3/1986 | Wolff . | |
| 4,609,190 | 9/1986 | Brentham . | |
| 4,629,185 | 12/1986 | Amann | 482/113 |
| 4,651,986 | 3/1987 | Wang . | |
| 4,667,955 | 5/1987 | Giesch | 482/113 |
| 4,722,525 | 2/1988 | Brentham . | |
| 4,726,583 | 2/1988 | Olsen et al. | 482/113 |
| 4,741,529 | 5/1988 | Bloemendaal . | |
| 4,934,695 | 6/1990 | Wolff | 482/113 X |
| 4,944,508 | 7/1990 | Collins | 482/92 X |

FOREIGN PATENT DOCUMENTS

| | | | |
|---|---|---|---|
| 2029243 | 3/1980 | United Kingdom | 482/112 |
| 8400496 | 2/1984 | WIPO | 482/112 |
| 8606644 | 11/1986 | WIPO | 482/112 |
| 8809195 | 12/1988 | WIPO . | |

*Primary Examiner*—Richard J. Apley
*Assistant Examiner*—John Mulcahy
*Attorney, Agent, or Firm*—Roylance, Abrams, Berdo & Goodman

[57] ABSTRACT

Exercising device comprising a moving unit (1–6'), a motion-transferring mechanism (7, 10–11') connected to the moving unit, and a hydraulic system (8–9, 12–17) connected to said motion transferring mechanism for controlling the motions of the moving unit. The invention is characterized in that the moving unit comprises a substantially vertically movable, tubular rod (1) with an integrated mounting (2, 2') at each end, and two separate, flexible and elongate elements (4, 4'). Each element is fixedly attached to a stationary fastening means (5, 5', 6, 6') above and, respectively, below the rod (1). Moreover, each element is arranged to extend through the tubular rod between the associated upper and, respectively, lower fastening means. The motion-transferring mechanism comprises at least one flexible, elongate member (7, 7') which is fixedly attached to one mounting (2) of the movable rod and to the through piston rod (8) of a piston cylinder (9) included in the hydraulic system. In addition to the piston cylinder, the hydraulic system comprises a control circuit (15–17) connected to the piston cylinder.

9 Claims, 4 Drawing Sheets

MUSCLE EXERCISING DEVICE

The present invention relates to an exercising device comprising a moving unit, a motion-transferring mechanism connected to said moving unit, and a hydraulic system connected to the motion-transferring mechanism for controlling the motions of the moving unit.

More precisely, the invention relates to a double-acting, hydraulic exercising device.

U.S. Pat. No. 4,667,955 discloses an exercising device as described above. The hydraulic system of the device is also designed for individual control of the kinetic resistance thereof. This is effected by means of a pair of adjustable throttle valves, which does not give the handle a constant speed at different loads. Further, this prior-art device produces a guided, arcuate motion, since the rod is attached to the end of a pivotably mounted arm. However, this motion is no real or natural motion and besides is quite incorrect in certain exercising programmes, such as when doing presses. Finally, the setting of the device must be changed for different exercises by moving the arm along an upright, said exercises necessitating different heights for the rod.

Exercising devices are used by sportsmen who wish to improve in their kind of sport, persons practising a profession which involves strenous work, e.g. nursing staff, body-builders and persons doing physical exercise to maintain or develop a good physique. The device is also advantageously used by disabled persons and persons tied to their wheelchair or confined to bed. Thus, there is a need of such devices in places of work, hospitals, at physiotherapists, at health farms, at home and in gyms.

A good exercising device should enable motions of exercise which alternately stress the agonist or antagonist. In each exercise, a muscle or a combination of muscles is working. In the compulsory return motion, the counteracting muscle or group of muscles is working. One-sided training resulting in uneven distribution of the muscles is counteracted by means of devices having a double-acting function. For optimum results, the muscle is to be exercised under maximum load during the entire movement. The training should be effected entirely on the exercising person's conditions and not on the conditions of the device, which applies both to sound persons and to those with reduced functions, the device preferably being settable in the range 1 kP–300 kP.

Double-acting training of groups of muscles counteracting each other produces a flow of blood to the working muscles, which is constantly high during the exercise. By alternatively contracting and stretching the muscles they are made smoother and more flexible. The double-acting function, which is desired in an exercising device, is used by physiotherapists, inter alia for relieving the patients' muscles of tension and for increasing the patients' muscular strength. The physiotherapist's manual and strenuous can in many cases be taken over by a well-functioning exercising device by means of which the patient can exercise on his own according to instructions, without the physiotherapists's assistance. Finally, a well-functioning exercising device should permit exercising of all large group of muscles, but most of the exercising devices available on the market are not designed for this, but only for separate exercises.

The object of the present invention thus is to provide an exercising device having a double-acting function, for exercising all large groups of muscles in the body.

A further object of the invention is to provide an exercising device by means of which an optimum speed of motion can be obtained, which is settable in both directions and independent of the load.

A still further object of the invention is to provide an exercising device which permits natural motions of exercise and which is readily adjustable for different exercises.

One more object of the invention is to provide an exercising device which, in its unloaded state, is immovable in every position and which is automatically adapted to the user's varying force and to the geometry of the motion of exercise, is not appreciably affected by uneven load and can be adapted to various exercising programmes.

According to the invention, these objects are achieved in that said moving unit comprises a substantially vertically movable, tubular rod with an integrated mounting at each end, and two separate, flexible and elongate elements, each element being fixedly attached to a stationary fastening means above and, respectively, below said rod, and being arranged to extend through the tubular rod between the associated upper and, respectively, lower fastening means, that the motion-transferring mechanism comprises at least one flexible, elongate member which is fixedly attached to one mounting of said movable rod and to the through piston rod of a piston cylinder included in said hydraulic system, and that the hydraulic system comprises, in addition to the piston cylinder, a control circuit connected to said piston cylinder.

Further developments of the invention are apparent from the features stated in the subclaims.

An embodiment of the invention has been realized and tested and will be described in more detail below, the rod of the moving unit serving as a bar-bell. Since the rod was suspended in a pair of cables, movability was provided in both vertical and horizontal direction, which resulted in a feeling of "free weights", which is something that many exercising persons prefer to strict "machine motions". If you exercise alone with heavy weights, for example doing being presses or knee-bending, you are in real trouble if you do not have strength enough for the last repetition. Serious accidents have happened. When using the exercising device according to the present invention, you stop exercising whenever you wish. The device immediately turns "powerless" when the exercising motion ceases, and the rod is "parked" in the air and remains in this position until the exercise continues or the rod is moved aside. Thus, the training will be completely safe with the exercising device according to the invention, and there is no need of an assistant.

The invention provides an all-round exercising device at a low investment cost and with but small space requirement, by means of which several groups of muscles can be exercised in the same exercise. For example, calves and forearm muscles can be integrated in the exercising of other groups of muscles, a so-called multi-set. Furthermore the exercises may be varied. During a set, the exercises may be alternated. The exercising device automatically adapts to the varying strength.

In "single-acting" heavy training with weights, a muscle or a group of muscles begins to ache after a number of repetitions. As a rule, the training is then discontinued owing to the unpleasant feeling that arises as a consequence of the lactic acid in the muscles, and not because the training of the muscle is complete. In "double-acting" heavy training—alternatively contraction and stretching—in the exercising device according to the present invention, no unpleasant feeling caused by lactic acid has been experienced. Of course the muscles become strained during exercising, but the device automatically follows the momentary weakening of the muscle. After "single-acting" fitness training, you should do some stretching in order to limber up. Having exercised in the exercising device according to the invention, the muscles were felt to be soft and relaxed. No stretching was required, but was automatically obtained by the "double-acting" exercising.

preferred embodiments of the invention will now be described for the purpose of exemplification and with reference to the accompanying drawings in which.

Figure 1:
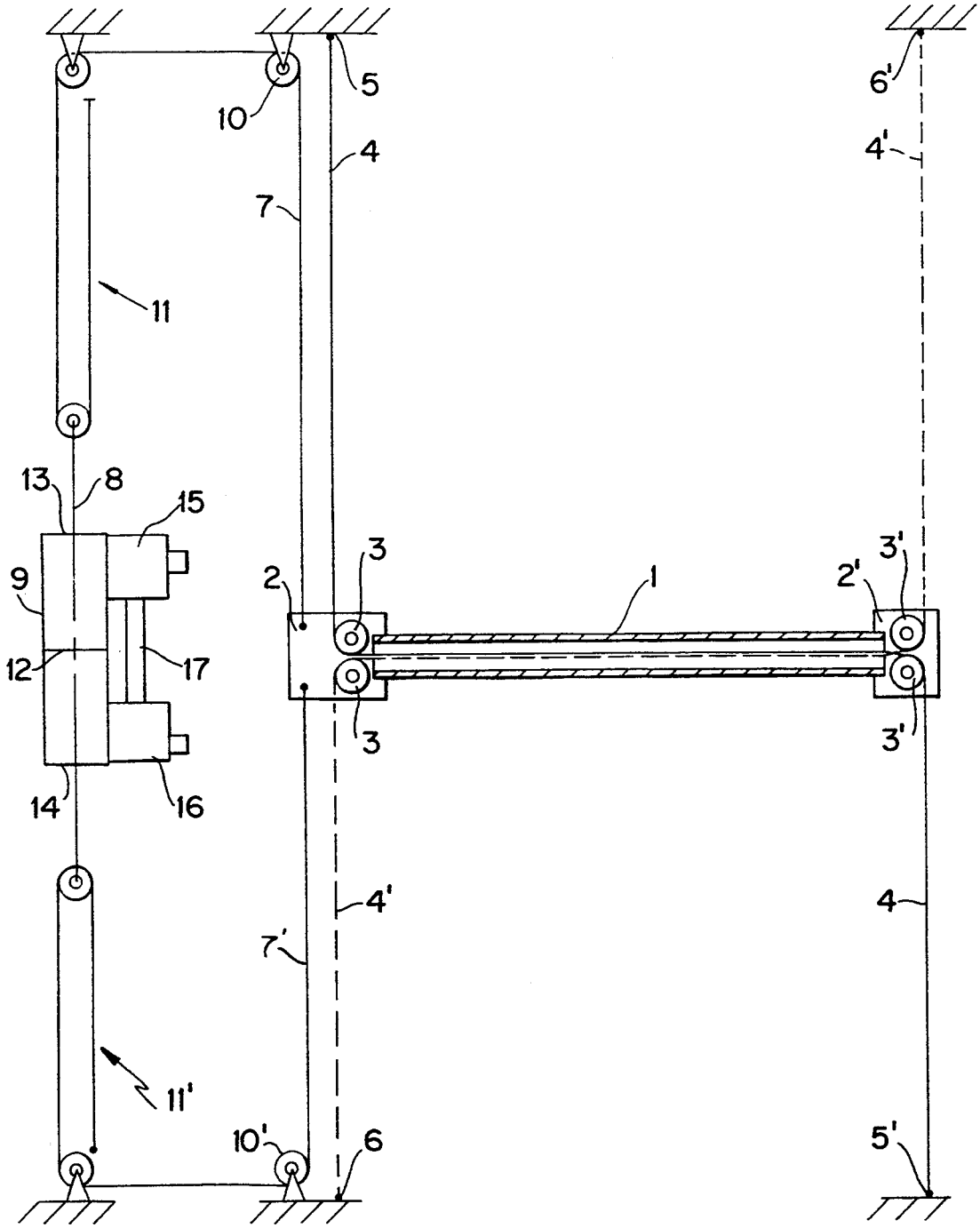
FIG. 1 illustrates schematically the main components of a preferred embodiment of the exercising device according to the invention.

With reference first to FIG. 1, there is shown an exercising device according to the invention whose main components are a moving unit, a motion-transferring mechanism connected to the moving unit; and a hydraulic system connected to the motion-transferring mechanism for controlling the motions of the moving unit.

The moving unit comprises a horizontally oriented, tubular rod 1 which can be the exercising rod in e.g. simulated weight-lifting. The rod 1 comprises an integrated mounting 2 and 2' at each end, each mounting 2 and 2' having a pair of rotary deflecting rollers 3 and 3'. A first flexible, elongate element 4 in the form of a cable, wire or the like is fixedly attached at one end to a stationary fastening means 5 above one mounting 2 of the rod 1 and at its other end to a stationary fastening means 5' below the other mounting 2' of the rod 1. Between the fastening means 5 and 5', the flexible element 4 runs over the associated upper deflecting roller 3 at the mounting 2, through the tubular rod 1, and over the associated lower deflecting roller 3' at the mounting 2'. The cable 4 or the like is in prior-art manner arranged to have a given tension.

Correspondingly, an identical cable 4' or the like runs from a stationary fastening means 6 below one mounting 2 of the rod 1, over the associated lower deflecting roller 3 at the mounting 2, through the tubular rod 1, over the associated upper deflecting roller 3' to a stationary fastening means 6' above the other mounting of the rod 1. The second flexible element 4' has the same tension as the first element 4, and the fastening means 5 and 6' are arranged vertically above the fastening means 6 and 5' and the pairs of deflecting rollers 3 and 3'. In FIG. 1, the deflecting rollers of each pair are arranged above one another, but they may be offset in horizontal direction, whereby the cables 4 and 4' are laterally offset in the rod 1. The fastening means 5, 5', 6 and 6' can be mounted on a frame (not shown) or attached to the floor and ceiling of a room or to some other suitable, stable object.

The above-described manner in which the two cables or the like run implies that the rod 1 is always kept horizontal, independently of where the force is applied on the rod and independently of the vertical position of the rod. Parallel moving of the rod in vertical direction will thus be possible. The flexibility of the elongate elements 4 and 4' also makes the rod horizontally movable during exercising, which results in more possibilities—the movability may be compared with training with free weights as to the path of motion of the exercising rod 1.

The above-mentioned motion-transferring mechanism comprises a flexible, elongate member 7 in the form of a cable, wire, chain or the like which is fixed attached to one mounting 2 of the rod 1 and to a trough piston rod 8 belonging to a piston cylinder 9 included in the hydraulic system. The member 7 runs over a deflecting roller 10 (where appropriate, a gear wheel) which preferably is arranged adjacent the fastening means 6 and over a second deflecting roller (not shown) (or a gear wheel) arranged on the same level as the deflecting roller 10 and on the axial line of the piston rod 8. An identical member 7' is arranged in a corresponding manner opposite the member 7 with which it cooperates. The members 7 and 7' are also in prior-art manner arranged to have a given tension. The second deflecting roller can, when necessary, be replaced by a block system 11, as shown in FIG. 1, for the desired ratio of the motions of the rod 1 to those of the piston rod 8.

The hydraulic system of the exercising device, which applies (counteracting) force, is schematically shown in FIG. 1 and comprises the above-mentioned, vertically oriented piston cylinder 9 with a through piston rod 8. The piston 12 has a surface towards the upper end 13 of the piston cylinder, which is of the same size as the surface towards the lower end 14 thereof. The ends 13 and 14 are interconnected by means of associated constant flow valves 15 and 16 and a circuit 17. The constant flow valves 15 and 16, which preferably are individually adjustable, provide a constant speed which is independent of the applied force. The greater force applied to the piston rod 8 and the cooperating constant flow valve 15 or 16, the greater reaction force supplied by the valve. The resistance thus arises as a reaction force which continuously and automatically adapts to the user's strength that varies during exercising. Therefore the load need not be adjusted, which saves time and renders the training more effective. Moreover, the speed is made independent of the load by means of these constant flow valves. Consequently, the constant flow valve distinguishes from a throttle valve whose function depends on the pressure drop across the throttle valve. As is obvious to the expert, the piston cylinder 9 is fixedly attached to the frame of the exercising device or in some other suitable manner. Further the through piston rod results in the piston 12 having an operating surface of the same size towards both ends 13 and 14, thereby eliminiting the need for a separate expansion tank to compensate for different piston displacements, which would be the case with a piston cylinder having a single piston rod. The vertical orientation of the piston cylinder 9 further makes it possible to compensate for the weight of the rod 1 by the weight of the piston rod 8 plus the piston 12, when required with an additional weight attached to the lower free end of the piston rod (at 11'). Then the rod 1 can immovably keep any position taken, which makes it possible even for persons having very low muscular strength to move the rod, e.g., in physiotherapy.

Figure 3:
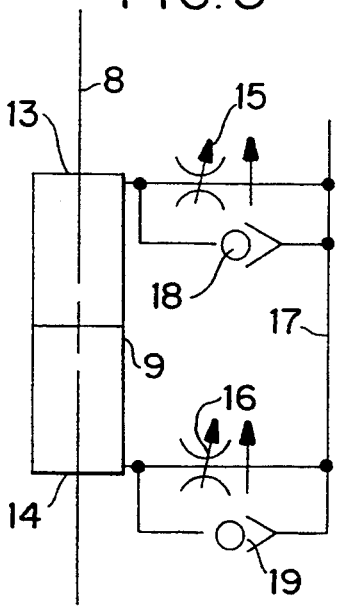
FIG. 3 illustrates in more detail the hydraulic system in FIG. 1.

Reference is now made to FIG. 3 which illustrates in more detail a preferred embodiment of the hydraulic system for the exercising device. To each end 13 and 14 of the piston cylinder 9 there is connected a constant flow valve 15 and 16, respectively, which can be fixed or adjustable. A check valve 18 and 19 is connected in parallel with the respective constant flow valve, and the valve groups 15, 18 and 16, 19 are connected to each other via the circuit 17. By means of this hydraulic system, the speed of the moving rod 1 when loaded can be individually controlled in both vertical directions of motion thereof.

Figure 4:
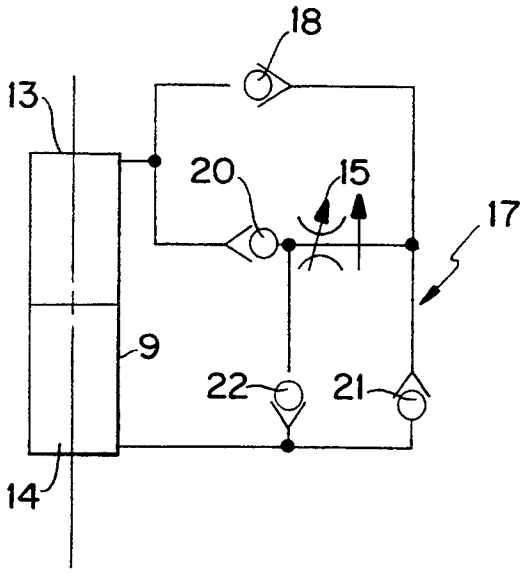
FIG. 4 shows a simplified variant of the hydraulic system according to FIG. 3.

FIG. 4 shows a simplified variant of the hydraulic system according to FIG. 3, which only comprises one constant flow valve 15 as described above. In addition to the check valve 18, a check valve 20 is connected in series with the constant flow valve 15. The circuit 17 comprises two branches each having a check valve 21, 22. This variant of the hydraulic system results in the same speed of the rod 1 in both directions of motion thereof.

Figure 5:
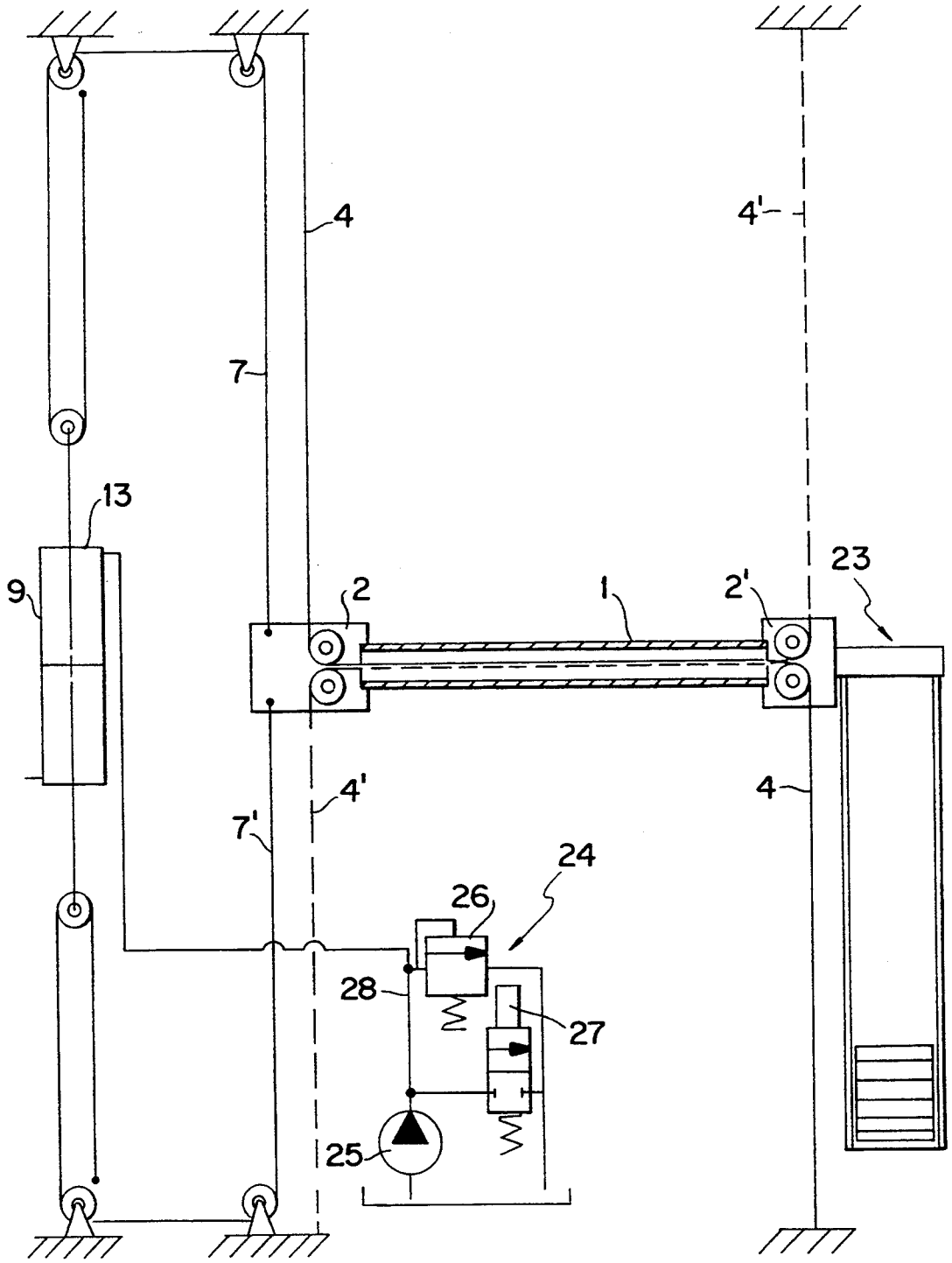
FIG. 5 shows schematically a broken away portion of a variant of the exercising device according to the invention with a weight-carrying device and a hydraulic system for "lifting assistance"

The exercising device can also be used for eccentric training which is popular among body-builders. This form of training is based on the knowledge that a person can lower a weight which is 30–40% higher than the weight he manages to lift. Conventionally, such training is performed by having some assisting persons help the exerciser to lift the extraordinary weight (the bar-bell), whereupon he lowers the weight on his own. This is repeated a number of times. FIG. 5 illustrates a broken-away portion of the exercising device which has been modified for eccentric training. The mounting 2' of the rod 1, which is opposed to the mounting 2 with the elongate flexible element 7, is fitted with a weight-carrying device which is generally designated 23. The device 23 corresponds to the above-mentioned excess weight of 30–40%. In order to provide "lifting assistance" for the device 23, a hydraulic system 24 is connected to the upper end 13 of the piston cylinder 9. A pump 25 feeds hydraulic oil under pressure to the piston cylinder 9 and helps the user to lift the rod 1 with the weight-carrying device 23. The amount of the desired "lifting assistance" can be adjusted by means of a pressure control valve 26. When the lifting has been completed with the "lifting assistance", a solenoid valve 27 or an automatic valve is activated, whereby the pressure in the line 28 is relieved and the "lifting assistance" disconnected. The hydraulic system 24 can operate together with one of the systems in FIGS. 3 and 4, or it can operate separately. When the system 24 is intended to operate separately, pneumatic operation may be used instead. Optionally, a compressed-air cylinder may also replace the pump 25, and the desired lifting assistance may be adjusted by means of a pressure reducing valve.

Figure 6:
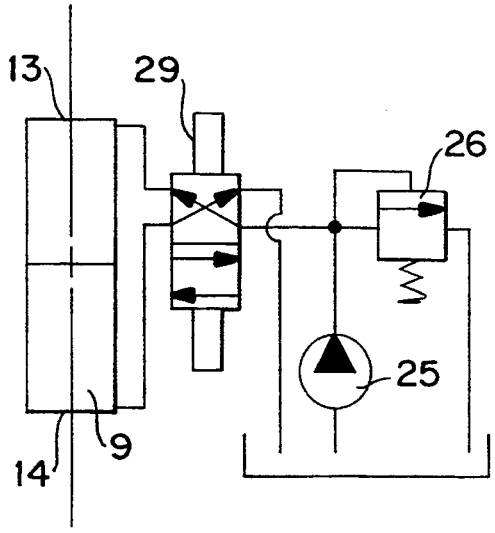
FIG. 6 shows a further variant of the hydraulic system for eccentric fitness training.

FIG. 6 shows a further variant of the hydraulic system for eccentric training. The rod 1 is automatically operated (or manually controlled) between upper and lower limit positions as adjusted. In this case, the exercising person tries to brake the motion. The hydraulic system comprises, in addition to the pump 25 and the pressure control valve 26, by means of which the force applied to the rod may be adjusted, a directional control valve 29 which is connected to both ends 13 and 14 of the piston cylinder 9. By means of the directional control valve 29, the vertical motions of the rod 1 thus are controlled.

Figure 7:
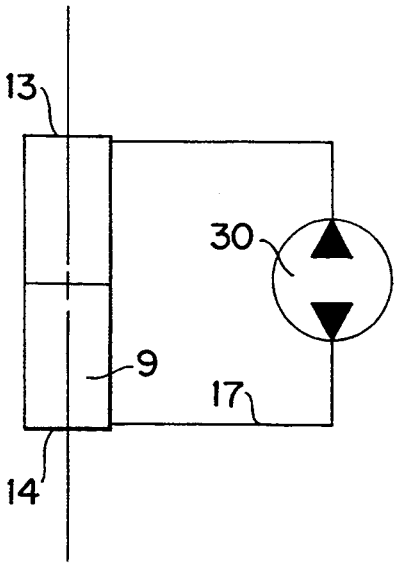
FIG. 7 shows one more variant of the hydraulic system for the exercising device according to the invention, when intended for rehabilitation.

One more variant of the hydraulic system is schematically shown in FIG. 7. In the circuit 17 between the two ends 13 and 14 of the piston cylinder 9 there is connected a reversing unit 30 which is shown in a simplified form. This variant is intended for rehabilitation of persons having very low muscular strength, who may not overcome the internal friction of the exercising device. Here the patient and the hydraulic system work in the same direction.

Figure 2:
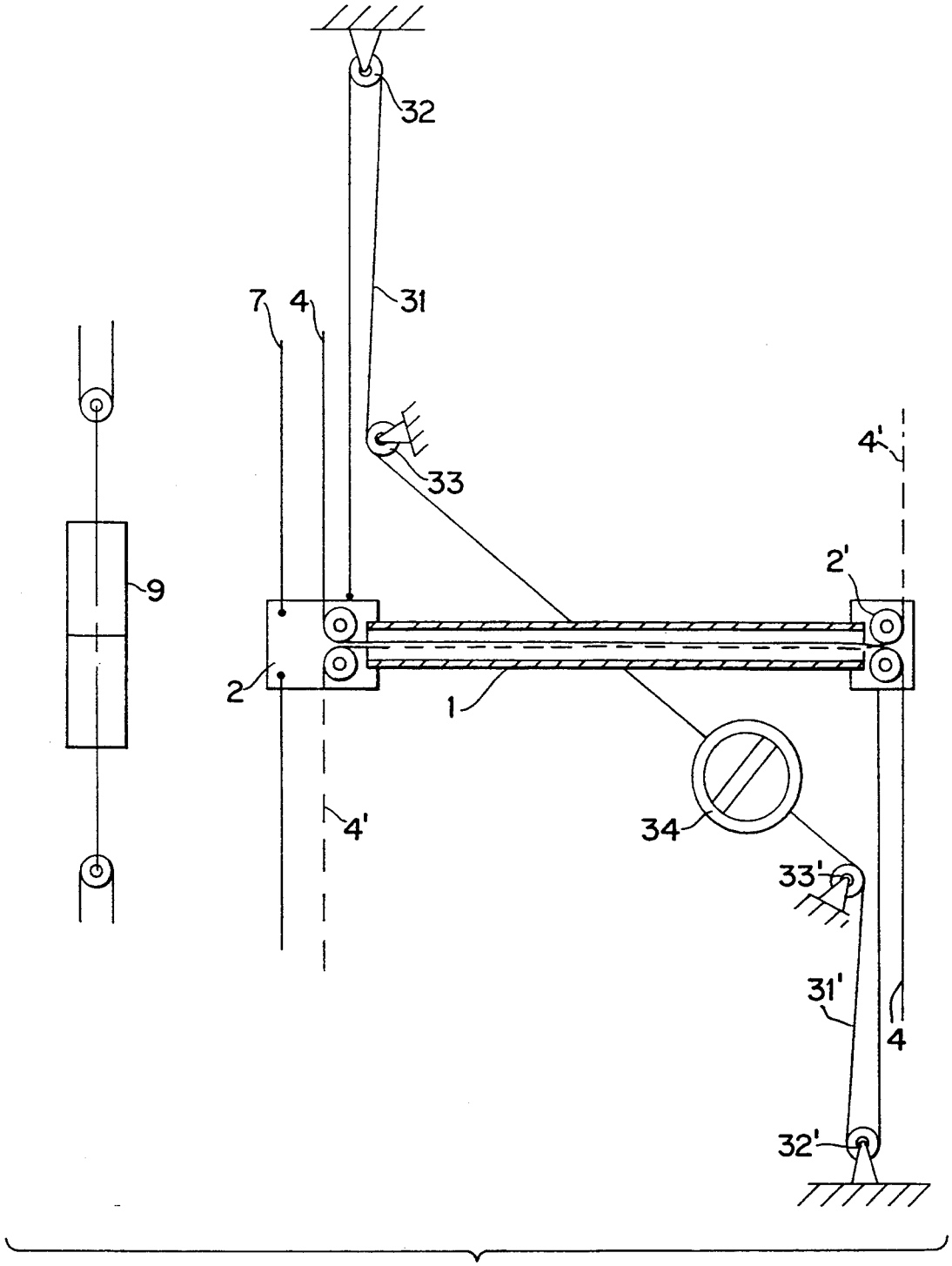
FIG. 2 shows schematically a broken away portion of the exercising device in FIG. 1 with an additional system for supplementary training of groups of muscles that are difficult to exercise.

In the above description, the exercising device has been presented with the rod 1 as the operated or operating means, the exercising rod or the handle for the user. FIG. 2, however, schematically shows that an additional system can be connected to the rod, especially for supplementary training of groups of muscles that are difficult to exercise. This additional system comprises a flexible element 31 similar to the element 4, whose ends are attached to the mountings 2 and 2' of the rod 1. The element 31 runs over deflecting rollers 32 and 32' which can be fixedly attached adjacent the fastening means 5 and 6' (cf. FIG. 1) or in some other stationary position. When required, additional stationary deflecting rollers 33 and 33' can be arranged between the first-mentioned deflecting rollers 32 and 32', over which deflecting rollers 33 and 33' the element 31 runs in order to obtain the desired orientation of the element 31 in relation to a holder or handle 34. The handle 34 is adapted to be used in the exercising of leg muscles, muscles of the neck etc. If desired, the portion of the element 31 between the handle 34 and one mounting 2 or 2' can be excluded and, if required, be replaced by a weight package or the like similar to the weight package 23 in FIG. 5. In this case, the element 31 may be arranged to extend outside the exercising device and to a bench or the like which the user wishes to utilise for special training operations in which the usual weights are replaced by the exercising device according to the invention.

The invention is not limited to what has been described above and illustrated in the drawings, but may be modified within the scope of the claims.

I claim:

1. An exercising device, comprising:

a tubular rod;

first and second mounting fixedly coupled to opposite ends of said rod;

first and second flexible elongated elements, each of said elongated elements having top and bottom ends, said first and second elongated elements extending oppositely through said tubular rod so that said top ends of said elongated elements extend from opposite ends of said tubular rod;

fastening means for attaching said top ends of said elongated elements to a support and for attaching said bottom ends of said elongated elements to the support, said bottom ends being below said top ends so that said tubular rod is movable in a generally vertical direction;

at least one flexible elongated member having first and second ends, said first end of said elongated member being attached to one of said mountings;

hydraulic means for providing a resistive force, said hydraulic means including a piston cylinder attached to said second end of said elongated member thereby providing a resistive force to movement of said tubular rod; and a control circuit for controlling the resistive force provided by said hydraulic means.

2. An exercising device according to claim 1 wherein said elongated member runs over deflecting rollers, said deflecting rollers being located above and below said rod;

attaching means are coupled to said deflecting rollers for coupling said deflecting rollers to stationary supports; and said piston cylinder includes a vertically oriented piston rod with opposite ends and a piston, said elongated member being attached to said opposite ends of said piston rod, said piston having opposite surfaces of the same size directed toward opposite ends of said piston cylinder.

3. An exercising device according to claim 2 wherein said elongated member runs over block systems located between respective ones of said deflecting rollers and said opposite ends of said piston rod, said block systems including block portions attached to said opposite ends of said piston rod and block portions fixedly attached to said attaching means and aligned with said piston rod.

4. An exercise device according to claim 1 wherein a cable extends over additional deflecting rollers, said cable being coupled to one of said mountings;

attaching means are coupled to said additional deflecting rollers for coupling said additional deflecting rollers to stationary supports; and a holder is coupled to said cable.

5. An exercising device according to claim 1 wherein a weight carrying device is attached to one of said first and second mountings.

6. An exercising device according to claim 1 wherein said hydraulic means control circuit comprises a constant flow valve means coupled to said piston cylinder for adjusting motion speed of said rod.

7. An exercising device according to claim 1 wherein said means control circuit comprises first and second constant flow valve means coupled to said piston cylinder for individually adjusting motion speed of said rod in each of opposite directions of movement of said rod.

8. An exercising device according to claim 1 wherein said hydraulic means comprises pump means coupled to said piston cylinder for facilitating movement of said rod in any direction.

9. An exercising device according to claim 1 wherein said hydraulic means comprises pump means coupled to said piston cylinder for moving said rod in any direction.

* * * * *